US010662961B2

(12) United States Patent
Campbell et al.

(10) Patent No.: US 10,662,961 B2
(45) Date of Patent: May 26, 2020

(54) PUMP WITH INTEGRATED BYPASS MECHANISM

(71) Applicant: INTERNATIONAL BUSINESS MACHINES CORPORATION, Armonk, NY (US)

(72) Inventors: Levi A. Campbell, Poughkeepsie, NY (US); Francis R. Krug, Jr., Highland, NY (US); Milnes David, Poughkeepsie, NY (US); Dustin Demetriou, New York, NY (US); Michael J. Ellsworth, Jr., Lagrangeville, NY (US); Brian Werneke, Pleasant Valley, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 84 days.

(21) Appl. No.: 15/801,397

(22) Filed: Nov. 2, 2017

(65) Prior Publication Data

US 2019/0128271 A1 May 2, 2019

(51) Int. Cl.

| | |
|---|---|
| ***F04D 29/042*** | (2006.01) |
| ***F04D 29/42*** | (2006.01) |
| ***F04D 27/00*** | (2006.01) |
| ***F04D 15/00*** | (2006.01) |
| ***F04D 29/20*** | (2006.01) |

(52) U.S. Cl.

CPC ..... *F04D 29/042* (2013.01); *F04D 15/0033* (2013.01); *F04D 27/009* (2013.01); *F04D 29/20* (2013.01); *F04D 29/426* (2013.01)

(58) Field of Classification Search

CPC .. F04D 29/042; F04D 29/426; F04D 15/0027; F04D 15/0038; F04D 15/005; F04D 29/20; F01P 5/00; F01P 5/10; F01P 7/161

USPC ..... 123/41.02, 41.08, 41.09; 415/144, 131; 416/206, 133, 135

See application file for complete search history.

(56) References Cited

U.S. PATENT DOCUMENTS 2,688,925 A * 9/1954 Thoren ..... F02M 17/18 417/203
3,720,372 A * 3/1973 Jacobs ..... B60H 1/038 237/12.3 B (Continued)

FOREIGN PATENT DOCUMENTS

CN 101400896 A 4/2009
CN 103899542 A 7/2014

(Continued)

*Primary Examiner* — Erick R Solis
*Assistant Examiner* — Robert A Werner
(74) *Attorney, Agent, or Firm* — Tihon Poltavets, Esq.; Kevin P. Radigan, Esq.; Heslin Rothenberg Farley & Mesiti P.C.

(57) ABSTRACT

A pump is provided which includes a rotating element, and a volute housing having a fluid inlet and a fluid outlet. In operational state, the rotating element rotates, drawing fluid through the fluid inlet of the volute housing and expelling the fluid at a higher pressure through the fluid outlet. Further, the pump includes a bypass mechanism integrated, at least in part, within the volute housing and exposing in nonoperational state of the pump, a bypass path through, at least in part, the volute housing that allows the fluid to pass from the fluid inlet to the fluid outlet of the pump.

10 Claims, 8 Drawing Sheets

(56) References Cited

U.S. PATENT DOCUMENTS

| | | | | |
|---|---|---|---|---|
| 3,801,224 | A | 4/1974 | Eberhardt | |
| 5,169,286 | A * | 12/1992 | Yamada | F01P 5/10 277/558 |
| 5,219,274 | A * | 6/1993 | Pawlowski | F04B 9/06 417/213 |
| 5,431,340 | A * | 7/1995 | Schirpke | B60H 1/08 237/12.3 B |
| 6,638,031 | B1 * | 10/2003 | Humburg | B60H 1/00485 237/12.3 B |
| 7,274,566 | B2 | 9/2007 | Campbell et al. | |
| 8,608,452 | B2 * | 12/2013 | Draheim | F04D 15/0038 415/131 |
| 9,599,112 | B2 * | 3/2017 | Durand | F01P 5/12 |
| 2009/0304531 | A1 * | 12/2009 | Vanderwees | H01M 8/04029 417/279 |
| 2010/0006044 | A1 * | 1/2010 | Duley | F01P 5/12 123/41.02 |
| 2011/0255963 | A1 * | 10/2011 | Kim | F04D 29/0513 415/211.2 |
| 2012/0204818 | A1 * | 8/2012 | Welte | F04D 15/0038 123/41.08 |
| 2015/0125313 | A1 | 5/2015 | Nyzen et al. | |

FOREIGN PATENT DOCUMENTS

| | | | |
|---|---|---|---|
| DE | 2746598 | A1 | 4/1979 |
| JP | 2016000985 | A | 1/2016 |

* cited by examiner

PUMP WITH INTEGRATED BYPASS MECHANISM

BACKGROUND

The power dissipation of integrated circuit chips, and the modules containing the chips, continues to increase in order to achieve continuing increases in processor performance. This trend poses a cooling challenge at both the module and system levels. Increased airflow rates are needed to effectively cool high power modules and to limit the temperature of the air that is exhausted into the computer center.

In many large server applications, processors along with their associated electronics (e.g., memory, disk drives, power supplies, etc.) are packaged in removable drawer configurations stacked within a rack or frame. In other cases, the electronics may be in fixed locations within the rack or frame. Typically, the components are cooled by air moving in parallel airflow paths, usually front-to-back, impelled by one or more air moving devices (e.g., axial or centrifugal fans). In some cases it may be possible to handle increased power dissipation within a single drawer by providing greater airflow, through the use of a more powerful air moving device or by increasing the rotational speed (i.e., RPMs) of an existing air moving device. However, this approach is becoming problematic at the rack level in the context of a computer installation or data center.

In some cases, the sensible heat load carried by the air exiting the rack is stressing the capability of the room air-conditioning to effectively handle the load. This is especially true for large installations with "server farms" or large banks of computer racks located close together. In such installations, liquid cooling (e.g., water cooling) is an attractive technology to manage the higher heat fluxes. The liquid absorbs the heat dissipated by the components/modules in an efficient manner, with the heat typically being transferred from the liquid to an outside environment, whether air or other liquid.

SUMMARY

In one or more aspects, the shortcomings of the prior art are overcome and additional advantages are provided herein through the provision of an apparatus which includes a pump. The pump includes a rotating element, a volute housing and a bypass mechanism. The volute housing has a fluid inlet and a fluid outlet. In operational state of the pump, the rotating element rotates, drawing fluid through the fluid inlet of the volute housing, across the rotating element and expelling the fluid at a higher pressure through the fluid outlet of the volute housing. The bypass mechanism is integrated, at least in part, with the volute housing and exposes in nonoperational state of the pump, a bypass path through the volute housing allowing the fluid to pass from the fluid inlet to the fluid outlet thereof.

In another aspect, an apparatus is provided which includes a coolant-cooled cooling assembly for facilitating cooling at least one electronic component, and at least one coolant pump in fluid communication with the coolant-cooled cooling assembly to facilitate flow of coolant through the coolant-cooled assembly. The at least one coolant pump includes a rotating element, a volute housing and a bypass mechanism. The volute housing has a fluid inlet and a fluid outlet. In operational state of the pump, the rotating element rotates drawing the coolant through the fluid inlet of the volute housing, across the rotating element and expelling the coolant at a higher pressure through the fluid outlet of the volute housing. The bypass mechanism is integrated, at least in part, with the volute housing and exposes in nonoperational state of the coolant pump, a bypass path through the volute housing allowing the coolant to pass from the fluid inlet to the fluid outlet thereof.

In a further aspect, a method is provided which includes providing a coolant pump for a coolant-cooled cooling assembly to facilitate cooling at least one electronic component of an electronic system. The providing includes a rotating element and a volute housing having a fluid inlet and a fluid outlet, wherein in operational state of the coolant pump, the rotating element rotates, drawing coolant through the fluid inlet of the volute housing across the rotating element and expelling the coolant at a higher pressure through the fluid outlet of the volute housing. Further, providing the coolant pump includes providing a bypass mechanism integrated, at least in part, with the volute housing and exposing in nonoperational state of the coolant pump, a bypass path through the volute housing allowing the coolant to pass from the fluid inlet to the fluid outlet thereof.

Additional features and advantages are realized through the techniques of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

In a conventional air-cooled data center, multiple electronics racks may be disposed in one or more rows, with the data center housing several hundred, or even several thousand, microprocessors within the electronics racks. Note that "electronics rack", "rack unit", "rack", "information technology (IT) infrastructure", etc., may be used interchangeably herein, and unless otherwise specified, include any housing, frame, support, structure, compartment, etc., having one or more heat-generating components of a computer system, electronic system, IT system, etc.

In an air-cooled data center, cooled air typically enters the data center via perforated floor tiles from a cool air plenum defined between a raised floor and a base or subfloor of the data center. Cooled air is taken in through air inlet sides of the electronics racks and expelled through the back or air outlet sides of the racks. Each electronics rack may have, for instance, one or more axial or centrifugal fans to provide inlet-to-outlet airflow to cool the electronic components within the one or more electronic systems of the electronics rack. The supply air plenum conventionally provides cooled and conditioned air to the air inlet sides of the electronics rack via perforated floor tiles disposed in a "cold" aisle of the data center, with the cooled and conditioned air being supplied to the plenum by one or more air-conditioning units, which are also typically disposed within the data center. Room air is taken into the air-conditioning units near an upper portion thereof. This room air may comprise, in part, exhausted air from the "hot" aisle(s) of the data center defined, for instance, by opposing air outlet sides of adjacent rows of electronics racks.

Figure 1:
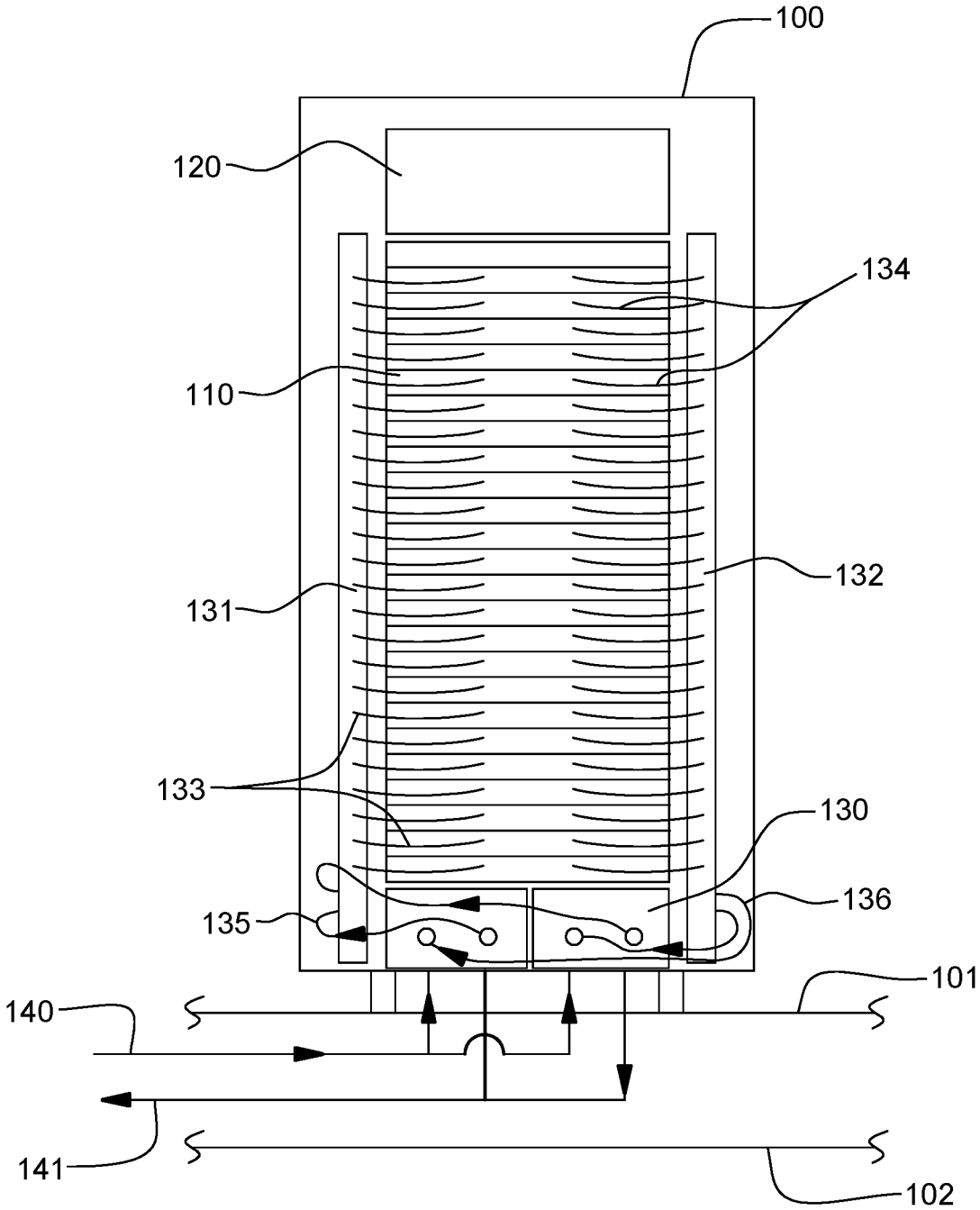
FIG. 1 is an elevational view of one embodiment of a coolant cooled electronics rack having multiple electronic systems or servers with cooling assemblies, in accordance with one or more aspects of the present invention.

Due to ever-increasing airflow requirements through electronics racks of a data center, and the limits of air distribution within the typical data center installation, liquid-assisted cooling may be desirable in combination with conventional air-cooling. FIG. 1 depicts one embodiment of an at least partially coolant-cooled electronics rack with one or more cooling assemblies (not shown), comprising one or more coolant-cooled heat sinks coupled to high-heat-generating electronic components, being disposed within the electronic systems or nodes of the electronics rack. Note that reference is made herein to the drawings, which are not necessarily drawn to scale to facilitate an understanding of the invention, where the same reference numbers used throughout different figures designate the same or similar components.

Referring to FIG. 1, an at least partially coolant-cooled electronics rack 100 may include, in one example, a plurality of electronic systems or nodes 110, which may be or comprise processor or server nodes. A bulk power regulator 120 may be disposed, for instance, in an upper portion of coolant-cooled electronics rack 100, and one or more coolant-conditioning units (CCUs) 130 may be disposed at a lower portion of the coolant-cooled electronics rack. In the embodiments described herein, the coolant may be a liquid coolant, such as water or an aqueous-based solution by way of example.

In addition to CCUs 130, the cooling system of coolant-cooled electronics rack 100 includes, by way of example, a rack-level coolant supply manifold 131, a rack-level coolant return manifold 132, and manifold-to-node fluid connect hoses 133 coupling rack-level coolant supply manifold 131 to one or more cooling assemblies within one or more electronic systems 110, and node-to-manifold fluid connect hoses 134 coupling the individual cooling assemblies within electronic systems 110 to rack-level coolant return manifold 132. Each CCU 130 is in fluid communication with rack-level coolant supply manifold 131 via a respective system coolant supply hose 135, and each CCU 130 is in fluid communication with rack-level coolant return manifold 132 via a respective system coolant return hose 136.

As illustrated, and by way of example only, a portion of the heat load of electronic systems 110 within electronics rack 100 may be transferred from the system coolant to, for instance, cooler facility coolant supplied via a facility coolant supply line 140 and a facility coolant return line 141 disposed, in the illustrated embodiment, in the space between a raised floor 101 and a base floor 102 of the data center housing the at least partially coolant-cooled electronics rack 100.

As explained further herein, cooling assemblies are provided, with one or more coolant-cooled heat sinks (or coolant-cooled cold plates) within electronic systems 110 of coolant-cooled electronics rack 100. The coolant-cooled heat sinks may be coupled to heat-generating electronic components of the electronic system, such as, for instance, processor modules, memory modules, etc. Heat is removed from the respective heat-generating electronic components via system coolant circulating through the coolant-cooled heat sinks within a system coolant loop defined by the coolant-conditioning units 130, rack-level manifolds 131, 132, and cooling assemblies within the individual electronic systems 110, which include the coolant-cooled heat sinks coupled to the electronic components being cooled. The system coolant loop and coolant-conditioning unit(s) may be designed to provide system coolant of a controlled temperature and pressure, as well as controlled chemistry and cleanliness to the coolant-cooled heat sinks coupled to the electronic components. In one or more embodiments, the system coolant may be maintained physically separate from the less-controlled facility coolant in, for instance, facility coolant supply and return lines 140, 141, to which heat may be ultimately transferred. Note that alternate heat dissipation implementations are also possible. For instance, the coolant-conditioning units 130 could be configured with one or more coolant-to-air heat exchangers to facilitate dissipating heat from the system coolant to an airflow passing through the coolant-conditioning units, for instance, from the air inlet side to the air outlet side of coolant-cooled electronics rack 100.

Figure 2:
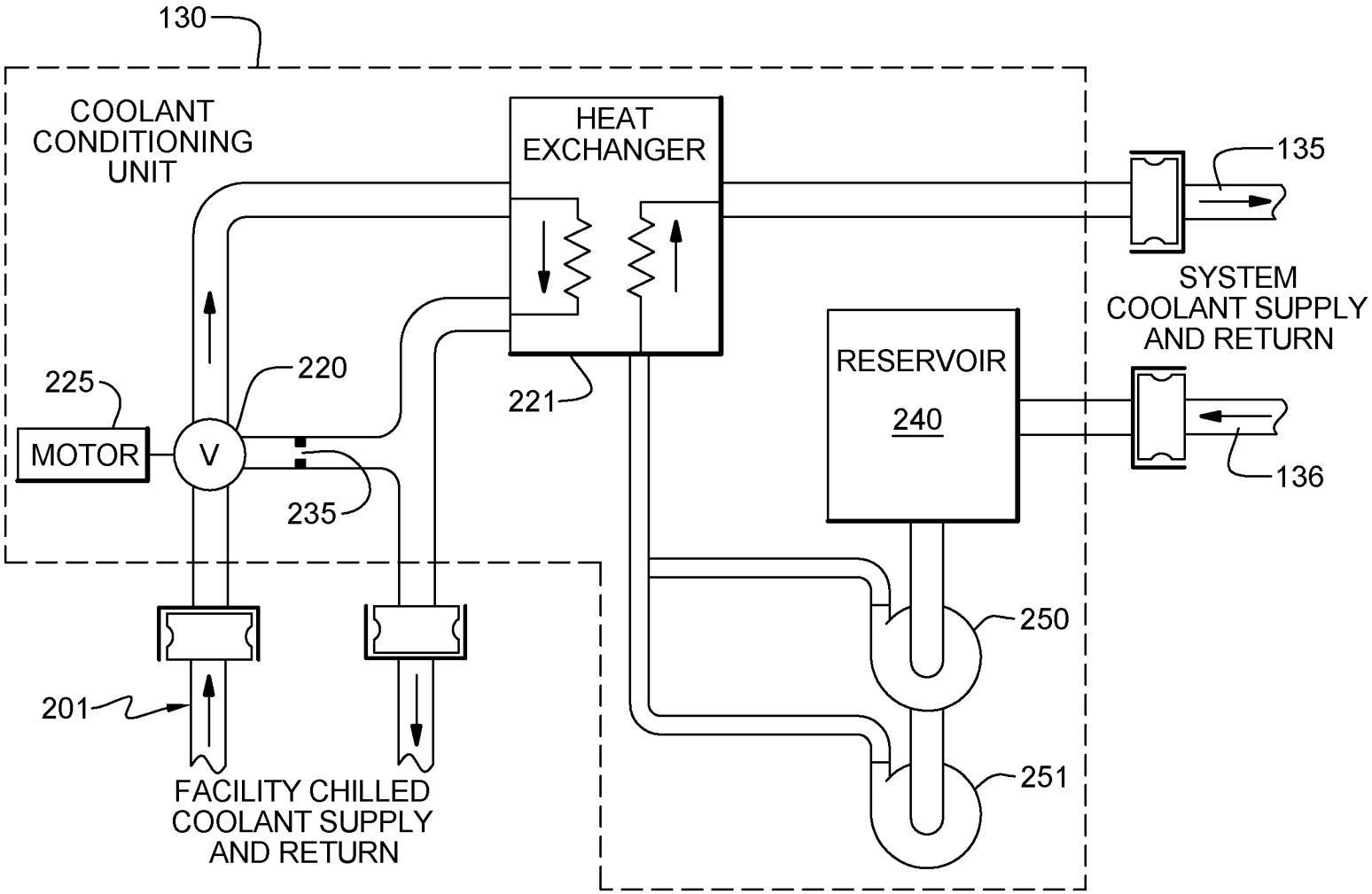
FIG. 2 is a schematic of one embodiment of a coolant-conditioning unit for one implementation of a coolant-cooled electronics rack such as depicted in FIG. 1, in accordance with one or more aspects of the present invention.

FIG. 2 depicts one embodiment of a coolant-conditioning unit 130. As shown, in one or more implementations, coolant-conditioning unit 130 includes a first coolant loop, wherein chilled facility coolant 201 is supplied and passes through a control valve 220 driven by a motor 225. Control valve 220 determines an amount of facility coolant to be passed through to a coolant-to-coolant heat exchanger 221, with a portion of the facility coolant possibly being returned directly via a bypass orifice 235. The coolant-conditioning unit 130 further includes a second coolant loop with a reservoir tank 240 from which system coolant is pumped, either by pump 250 or redundant pump 251, into coolant-to-coolant heat exchanger 221, for conditioning and output thereof, as cooled system coolant to the cooling assemblies within the electronic systems of the coolant-cooled electronics rack. For instance, the cooled system coolant may be supplied to the above-described rack-level coolant supply manifold, and be returned via the rack-level coolant return manifold of FIG. 1, using system coolant supply hose 135 and system coolant return hose 136.

Recent server system designs and architectures continue to drive the need for enhanced cooling approaches and structures to be developed to cool, for instance, higher-power processor chips or modules. An example of high-power processor chips or modules which may benefit from active liquid cooling include the System Z® Central Electronic Complex (CEC) processor modules offered by International Business Machines Corporation of Armonk, N.Y. By way of example, the electronic system to be cooled may be disposed in one or more horizontal drawer configurations comprising multiple distributed processor, single-chip modules (SCMs). The modules may be liquid coolant-cooled, such as water-cooled, via a liquid cooling system such as discussed above in connection with FIGS. 1 & 2, and an appropriate intra-drawer or intra-node manifold—heat sink assembly.

Figure 3:
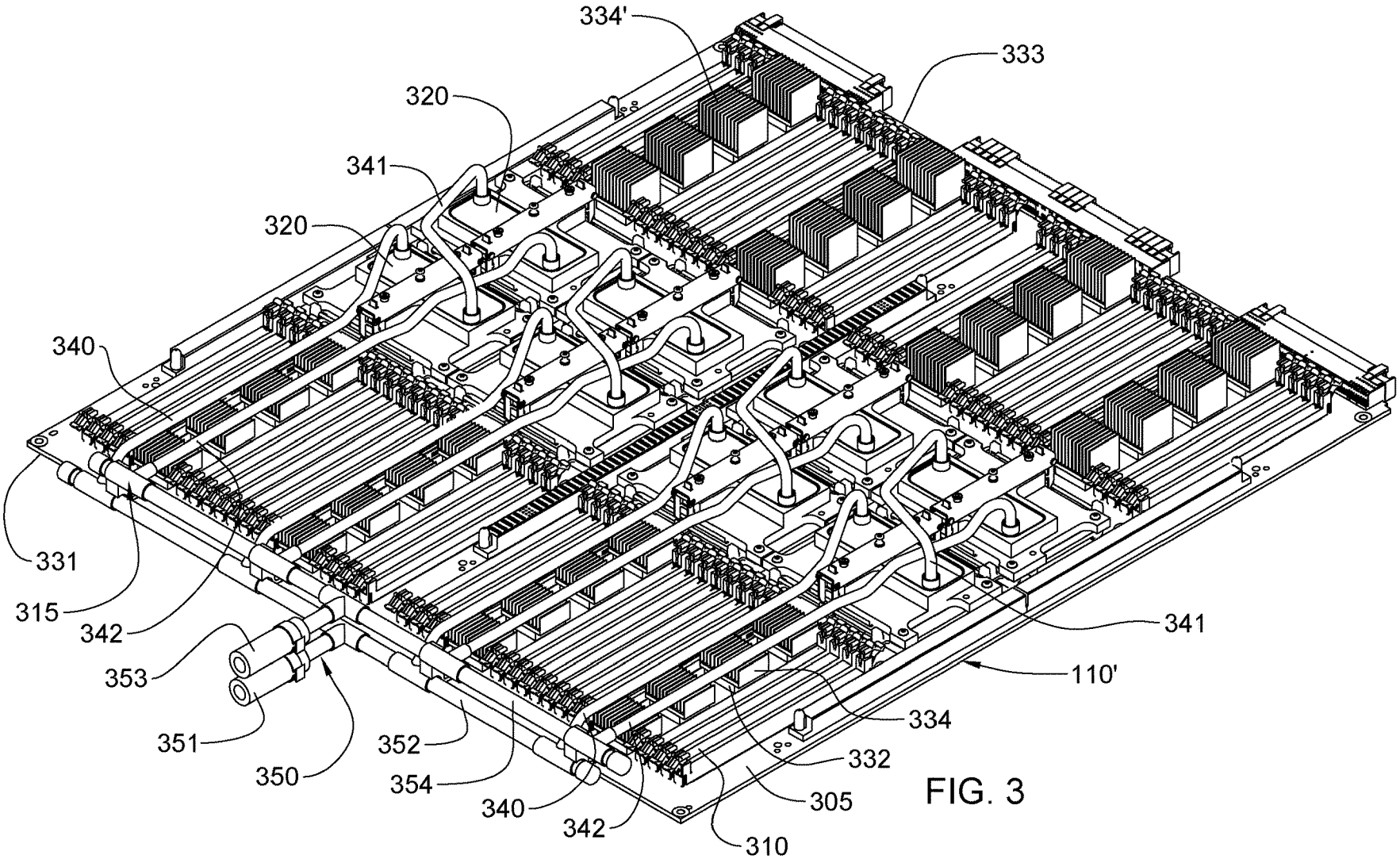
FIG. 3 depicts one embodiment of a partially assembled electronic system layout, wherein the electronic system includes eight high heat generating electronic components to be cooled, each having, in one embodiment, a respective coolant-cooled cold plate associated therewith through which coolant is pumped, in accordance with one or more aspects of the present invention.

By way of further explanation, FIG. 3 depicts one embodiment of an electronic system layout comprising eight processor modules, each having a respective liquid-cooled heat sink of a liquid-based cooling system coupled thereto. The liquid-based cooling system is shown to further include associated coolant-carrying tubes for facilitating passage of liquid coolant through the liquid-cooled heat sinks and a header subassembly to facilitate distribution of liquid coolant to and return of liquid coolant from the liquid-cooled heat sinks. By way of specific example, the liquid coolant passing through the liquid-based cooling subsystem may be cooled and conditioned (e.g., filtered) water.

FIG. 3 is an isometric view of one embodiment of an electronic system or drawer, and a cooling assembly. The depicted planar server assembly includes a multi-layer printed circuit board to which memory DIMM sockets and various electronic components to be cooled may be attached both physically and electrically. In the cooling assembly depicted, a supply header is provided to distribute liquid coolant from an inlet to multiple parallel coolant flow paths and a return header collects exhausted coolant from the multiple parallel coolant flow paths into an outlet. Each parallel coolant flow path may include one or more heat sinks in series flow arrangement to facilitate cooling one or more electronic components to which the heat sinks are coupled. The number of parallel paths and the number of series-connected liquid-cooled heat sinks may depend, for example, on the desired component temperature, available coolant temperature and coolant flow rate, and the total heat load being dissipated from the electronic components.

More particularly, FIG. 3 depicts one embodiment of a partially assembled electronic system 110' and an assembled liquid-based cooling system 315 coupled to primary heat-generating components (e.g., including processor die or electronic modules) to be cooled. In this embodiment, the electronic system is configured for (or as) a node of an electronics rack, and includes, by way of example, a support substrate or planar board 305, a plurality of memory module sockets 310 (with the memory modules (e.g., dual in-line memory modules) not shown), multiple rows of memory support modules 332 (each having coupled thereto an air-cooled heat sink 334), and multiple processor modules (not shown) disposed below the liquid-cooled heat sinks 320 of the liquid-based cooling system 315.

In addition to liquid-cooled heat sinks 320, liquid-based cooling system 315 includes multiple coolant-carrying tubes, including coolant supply tubes 340 and coolant return tubes 342 in fluid communication with respective liquid-cooled heat sinks 320. The coolant-carrying tubes 340, 342 are also connected to a header (or manifold) subassembly 350 which facilitates distribution of liquid coolant to the coolant supply tubes and return of liquid coolant from the coolant return tubes 342. In this embodiment, the air-cooled heat sinks 334 coupled to memory support modules 332 closer to front 331 of electronic system 110' are shorter in height than the air-cooled heat sinks 334' coupled to memory support modules 332 near back 333 of electronic system 110'. This size difference is to accommodate the coolant-carrying tubes 340, 342 since, in the depicted embodiment, the header subassembly 350 is at the front 331 of the electronics system and the multiple liquid-cooled heat sinks 320 are in the middle.

Liquid-based cooling system 315 comprises, in one embodiment, a pre-configured monolithic structure which includes multiple (pre-assembled) liquid-cooled heat sinks 320 configured and disposed in spaced relation to engage respective heat-generating electronic components. Each liquid-cooled heat sink 320 includes, in one embodiment, a liquid coolant inlet and a liquid coolant outlet, as well as an attachment subassembly (i.e., a heat sink/load arm assembly). Each attachment subassembly is employed to couple its respective liquid-cooled heat sink 320 to the associated electronic component to form the heat sink and electronic component (or device) assemblies depicted. Alignment openings (i.e., thru-holes) may be provided on the sides of the heat sink to receive alignment pins or positioning dowels during the assembly process. Additionally, connectors (or guide pins) may be included within the attachment subassembly to facilitate use of the attachment assembly.

As shown in FIG. 3, header subassembly 350 may include two liquid manifolds, i.e., a coolant supply header 352 and a coolant return header 354, which in one embodiment, may be mechanically coupled together via supporting brackets. In a monolithic cooling structure example, the coolant supply header 352 may be metallurgically bonded in fluid communication to each coolant supply tube 340, while the coolant return header 354 is metallurgically bonded in fluid communication to each coolant return tube 352. By way of example, a single coolant inlet 351 and a single coolant outlet 353 extend from the header subassembly for coupling to the electronics rack's coolant supply and return manifolds, such as shown in FIG. 1.

In one embodiment only, the coolant supply tubes 340, bridge tubes 341 and coolant return tubes 342 in the exemplary embodiment of FIG. 3 may be pre-configured, semi-rigid tubes formed of a thermally conductive material, such as copper or aluminum, and the tubes may be respectively brazed, soldered or welded in a fluid-tight manner to the header subassembly and/or the liquid-cooled heat sinks. The tubes may be pre-configured for a particular electronics system to facilitate installation of the monolithic structure in engaging relation with one or more selected components of the electronic system.

Figure 4:
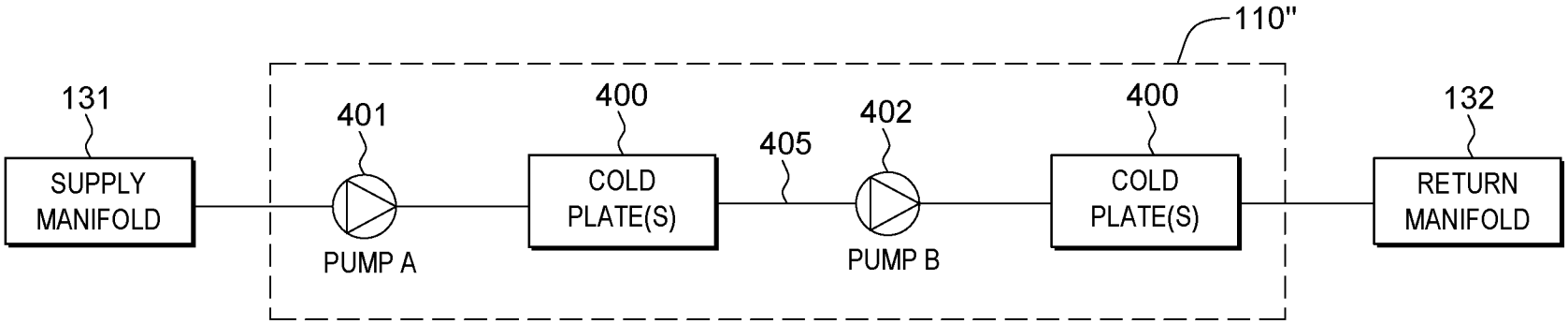
FIG. 4 depicts a schematic on an alternate embodiment of an electronic system cooling assembly with multiple pumps in series fluid communication with one or more cold plates, in accordance with one or more aspects of the present invention.

FIG. 4 is a schematic of another embodiment of an electronics system 110" and a liquid-coolant cooling assembly within electronic system 110". As shown, the cooling assembly includes (by way of example) one or more cold plates 400 (each coupled to one or more heat generating electronic components to be cooled (not shown)) and multiple series coupled coolant pumps 401, 402 (pump A, pump B). In this example, coolant pumps 401, 402 are redundant pumps coupled in series fluid communication with cold plates 400 between coolant supply manifold 131 and coolant return manifold 132, by way of example only. In one or more implementations, the cooling assembly may be or include a low-pressure liquid coolant loop 405 passing through electronic system 110". Redundant pumps 401, 402 may be provided so that if one pump should fail, that is, enter nonoperational state, the other pump still in operational state can provide the desired coolant flow through electronic system 110". Note that this approach can be employed with a variety of coolant-cooled electronic systems. For instance, as one variation, the coolant conditioning units of the coolant-cooled electronics rack of FIGS. 1-2 could be reconfigured to be coupled in series, with each series connected coolant conditioning unit including one or more series connected pumps.

One drawback to an approach such as depicted in FIG. 4 is that each of the pumps needs to be sized to provide the necessary coolant flow through the coolant pump at a pressure drop that includes at least one seized pump rotor (i.e., seized rotating element). The apparatuses and methods of fabrication disclosed herein overcome this limitation, allowing for pumps with smaller motors and smaller rotating elements (e.g., smaller impellers), potentially saving energy and cost in implementing the cooling assemblies.

Disclosed herein in one or more aspects are an apparatus and method of fabrication which include a pump, such as a coolant pump, with different fluid flow paths through the pump dependent on whether the pump is in an operational state or nonoperational state. By way of example, the pump includes a rotating element, a volute housing, and a bypass mechanism. The volute housing has a fluid inlet and a fluid outlet. In operational state of the pump, the rotating element rotates, drawing fluid through the fluid inlet of the volute housing, through or across the rotating element and expelling the fluid at a higher pressure through the fluid outlet of the volute housing. The bypass mechanism is integrated, at least in part, with the volute housing and exposes in nonoperational state of the pump, a bypass path through the volute housing allowing the fluid to pass from the fluid inlet to the fluid outlet thereof. The bypass path in the nonoperational state is a different fluid flow path through the pump than the flow path across the rotating element when in the operational state of the pump.

In one or more implementations, the bypass mechanism includes a spring disposed between the volute housing and the rotating element, and in the operational state, the higher pressure fluid pressurizes the rotating element within the pump, opposite the fluid inlet of volute housing forcing the rotating element to move towards the fluid inlet of the volute housing, compressing the spring between the volute housing and the rotating element. In the nonoperational state, the spring moves the rotating element away from the fluid inlet of the volute housing to expose the bypass path for the fluid to flow through the volute housing. In this manner, in the nonoperational state of such an implementation, the bypass path is defined between a surface of the rotating element and a surface of the volute housing.

In one or more other implementations, the bypass mechanism includes a valve disposed within the bypass path in the volute housing. In the nonoperational state, the valve transitions to allow fluid to pass through the bypass path from the fluid inlet to the fluid outlet of the volute housing. In one or more embodiments, the valve is a reed value directing fluid passing through the rotating element in the operational state of the pump to the fluid outlet of the volute housing, and in the nonoperational state, directing fluid passing through the bypass path to the fluid outlet of the volute housing.

In one or more implementations, the fluid outlet of the volute housing has an outlet flow diameter, and the bypass path includes a bypass flow diameter sized relative to the outlet flow diameter to minimize pressure drop through the pump when in the nonoperational state.

In one or more embodiments, the pump is one pump, and the apparatus further includes at least one other pump connected in series fluid communication with the one pump. The at least one other pump facilitating flow of the fluid through the bypass path when the one pump is in the nonoperational state. In one or more embodiments, the pump is a centrifugal pump, and the apparatus further includes a coolant loop, the pump being operatively coupled in fluid communication with the coolant loop to facilitate pumping of coolant through the coolant loop, where the fluid is the coolant.

Figure 5A:
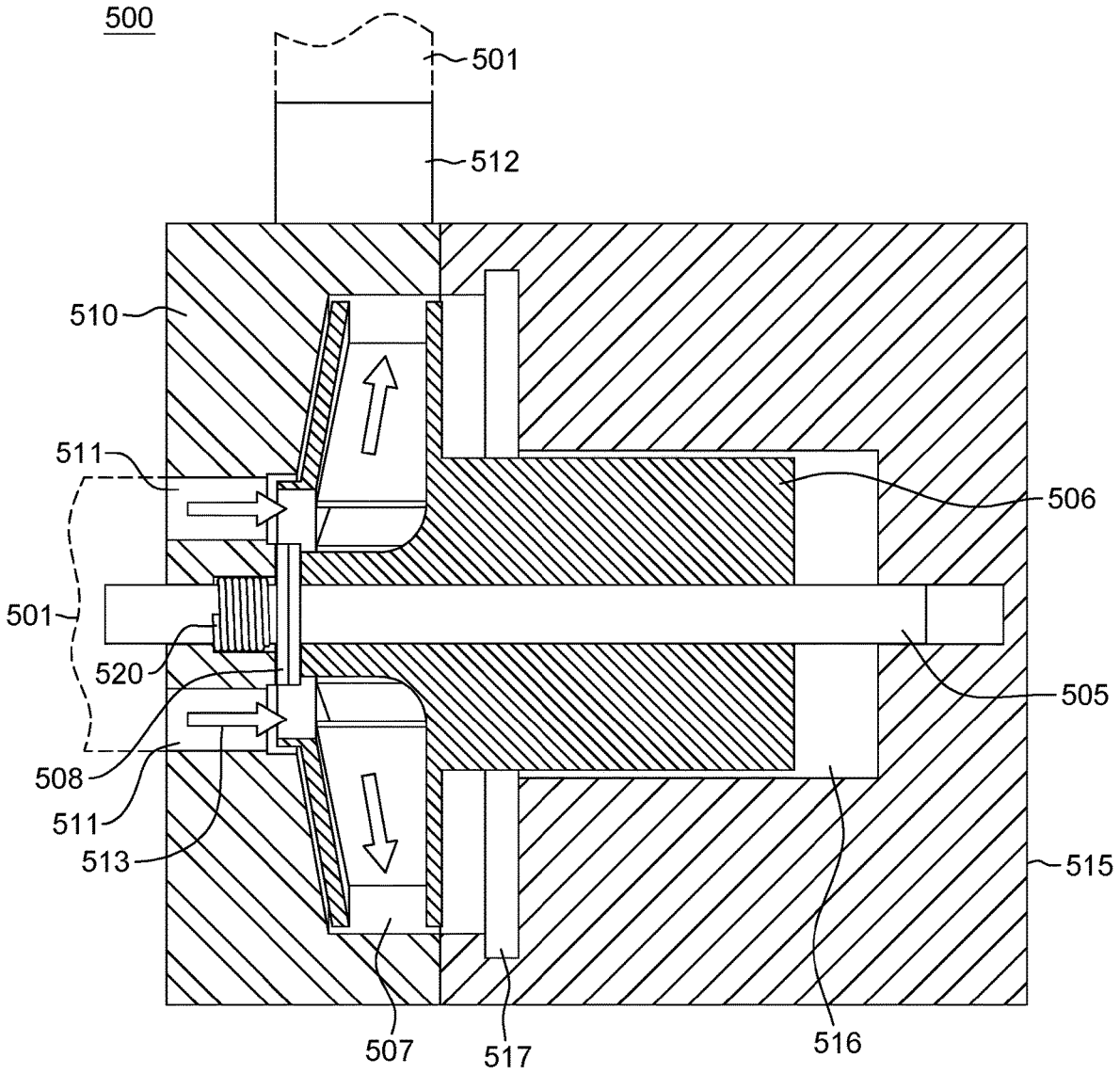
FIGS. 5A & 5B depict cross-sectional elevational views of one embodiment of a pump with an integrated bypass mechanism, shown in operational state, and nonoperational state, respectively, in accordance with one or more aspects of the present invention.
Figure 5B:
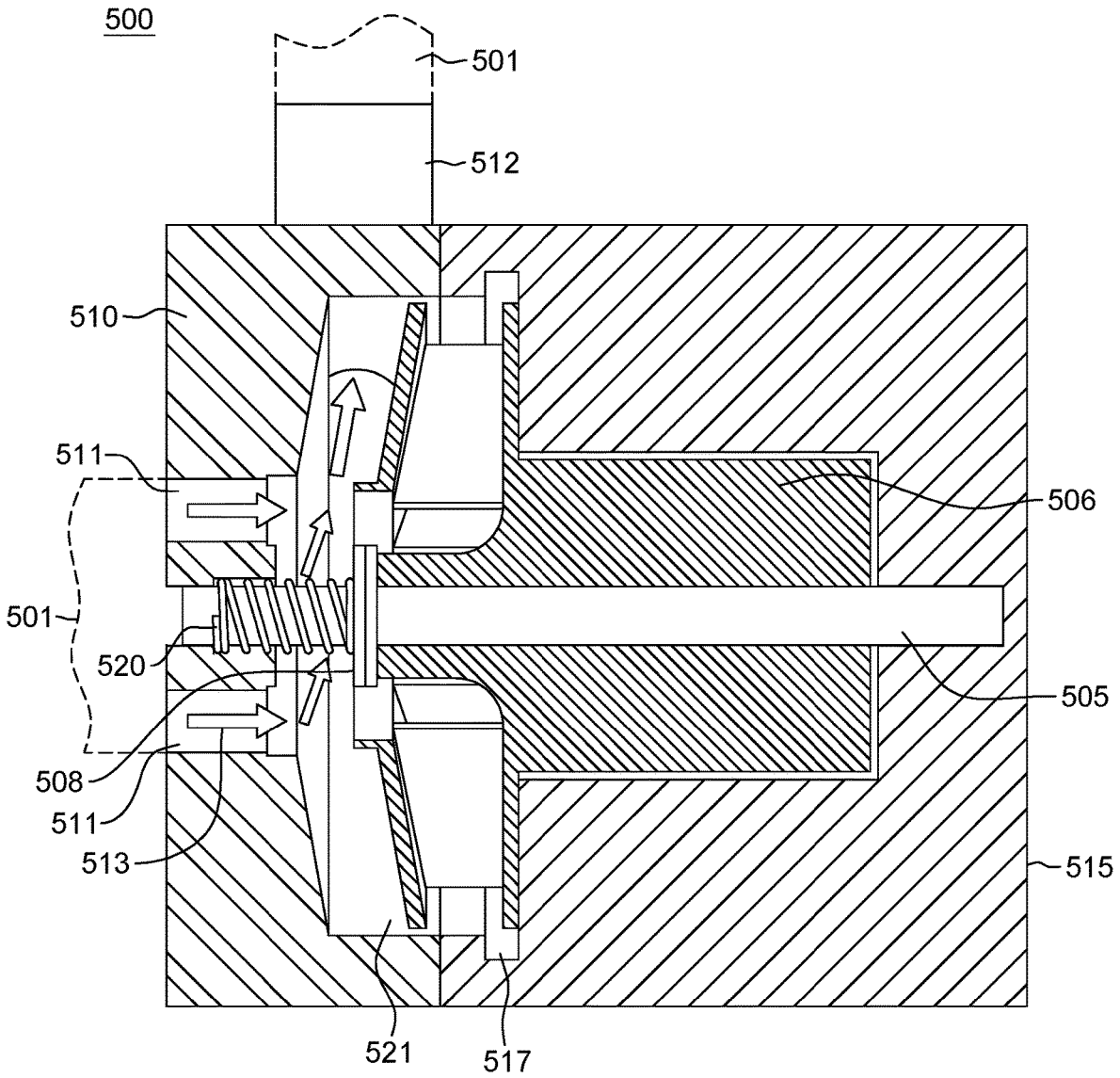

FIGS. 5A & 5B depict one embodiment of a pump 500, such as a centrifugal pump, coupled in fluid communication with a coolant loop 501 of a cooling assembly such as discussed herein. Referring initially to FIG. 5A, pump 500 is shown in operational state with an impeller 506 rotating about a shaft 505 within a housing comprising a volute housing 510 and a motor-side housing 515. Note that impeller 506 and shaft 505 in the configuration depicted in FIGS. 5A & 5B are one example only of a rotating element, such as described herein. In this implementation, impeller 506 rotates about shaft 505 and is moveable along shaft 505. In the example depicted, volute housing 510 includes a fluid inlet 511 and a fluid outlet 512, which as shown may be coupled in fluid communication with coolant loop 501. Impeller 506 is rotated about shaft 505 by a motor (not shown) and a fluid, such as a coolant, is drawn through fluid inlet 511 across impeller 506 through one or more channels 507 (formed by vanes of the impeller) to fluid outlet 512 of volute housing 510.

As shown in FIGS. 5A & 5B, pump 500 is modified from a conventional pump configuration to include a bypass mechanism which includes a spring 520 disposed about shaft 505 between volute housing 510 and a thrust bearing 508 affixed to shaft 505. Further, motor side housing 515 is provided with extra space 516 to allow transition or movement of impeller 506 between the operational state depicted in FIG. 5A and the nonoperational state depicted in FIG. 5B. As shown in FIG. 5B, spring 520 forces impeller 506 away from volute housing 510 when the pump is in the nonoperational state, exposing a bypass path 521 in the volute housing, that is, between a surface of volute housing 510 and an end surface of impeller 506 in this example. In the nonoperational state, the fluid is allowed to pass from fluid inlet 511 through bypass path 521 to fluid outlet 512. Further, the additional space 516 within motor-side housing, as well as the size of spring 520 are configured, in one or more implementations, such that the bypass path has a bypass (fluid) flow diameter sized to at least equal the outlet flow diameter of fluid outlet 512 in order to minimize pressure drop through pump 500 when in the nonoperational state.

More particularly, in one or more implementations, pump 500 is a centrifugal pump for use in, for instance, a series redundant pump system, for instance, such as described above. In operational state, the impeller rotates about the shaft, drawing fluid (such as coolant) into the fluid inlet of the volute housing and expelling the fluid at a higher pressure through the fluid outlet of the volute housing. The higher pressure fluid is permitted to pressurize the side of the impeller opposite the volute housing fluid inlet, forcing the impeller to move along the shaft towards the volute housing fluid inlet, and compress the spring between the volute housing and the impeller. In the event the pump is disabled, the spring moves the impeller along the shaft away from the inlet region of the volute housing, creating or exposing the bypass path for the fluid to pass through the pump.

As noted, FIG. 5A shows one embodiment of fluid 513 flowing through pump 500 in operational state, with the impeller spinning about the shaft, and fluid within the impeller being thrown to the outer diameter of the impeller by centrifugal force increasing the fluid's pressure with angular speed. At the fluid inlet, fluid pressure decreases as flow is accelerated by the impeller. A groove 517 in the housing ensures that the higher pressure fluid can communicate with the space 516 between the impeller 506 and the motor-side housing 515. Due to the inlet side to motor-side pressure difference, the impeller moves to the left in FIG. 5A, compressing the spring 520 and closing the bypass path between the impeller and the volute housing. In FIG. 5B, the pump is in nonoperational state, with the spring 520 adjacent to the fluid inlet pushing the impeller 506 towards to motor-side housing 515, exposing the bypass path between the volute housing and the impeller, and allowing fluid flow 513 to enter from the fluid inlet, driven by one or more separate (i.e., other) pumps connected in series communication (see FIG. 4), and to flow directly to the fluid outlet. This advantageously allows a redundant serial pump to provide flow through the system at a smaller pressure drop across the disabled or nonoperational pump, then would be required for a typical centrifugal pump design with a seized on nonoperational rotating element.

Figure 6A:
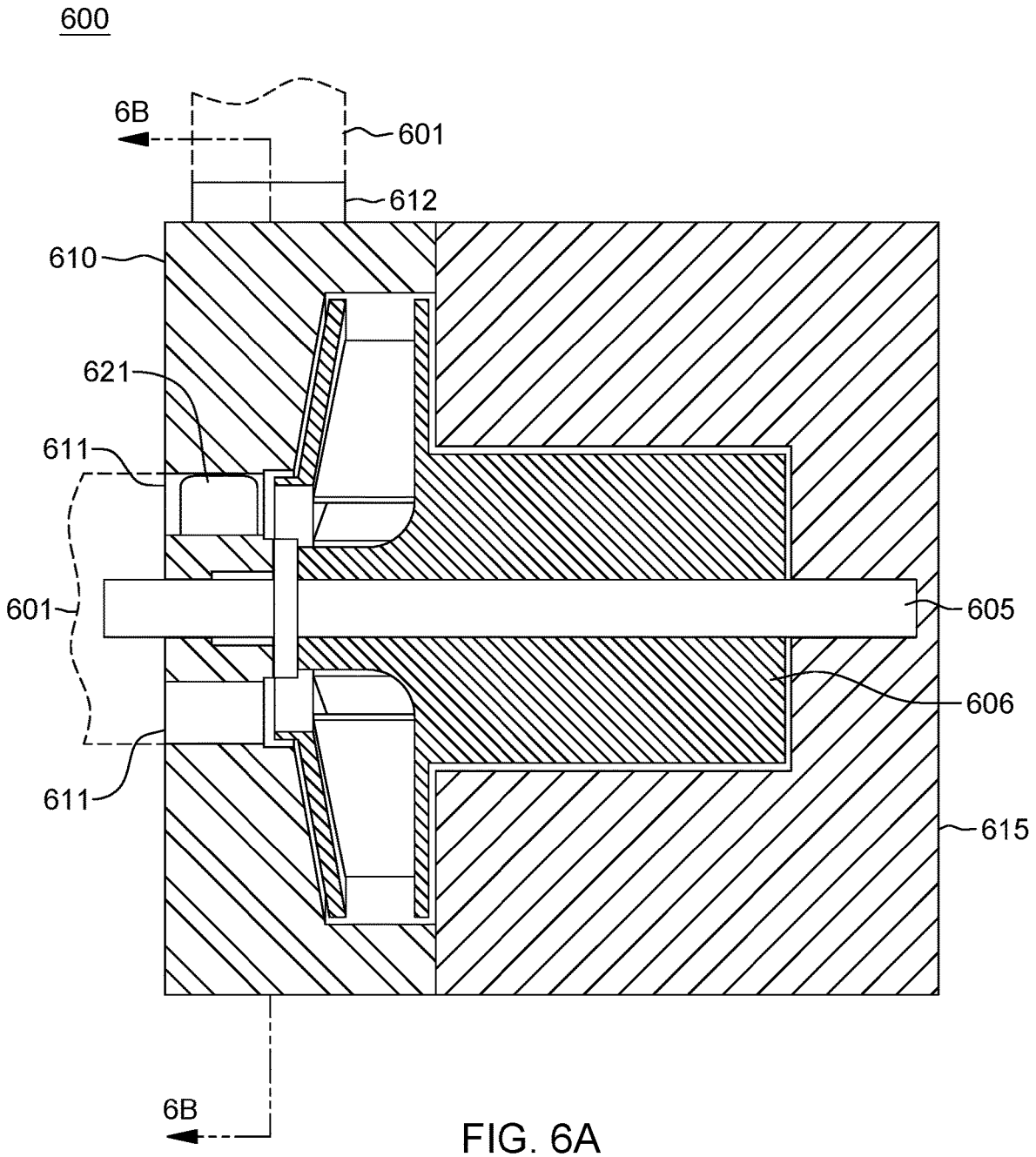
FIG. 6A is a partial cross-sectional elevational view of another embodiment of a pump with an integrated bypass mechanism, in accordance with one or more aspects of the present invention.
Figure 6B:
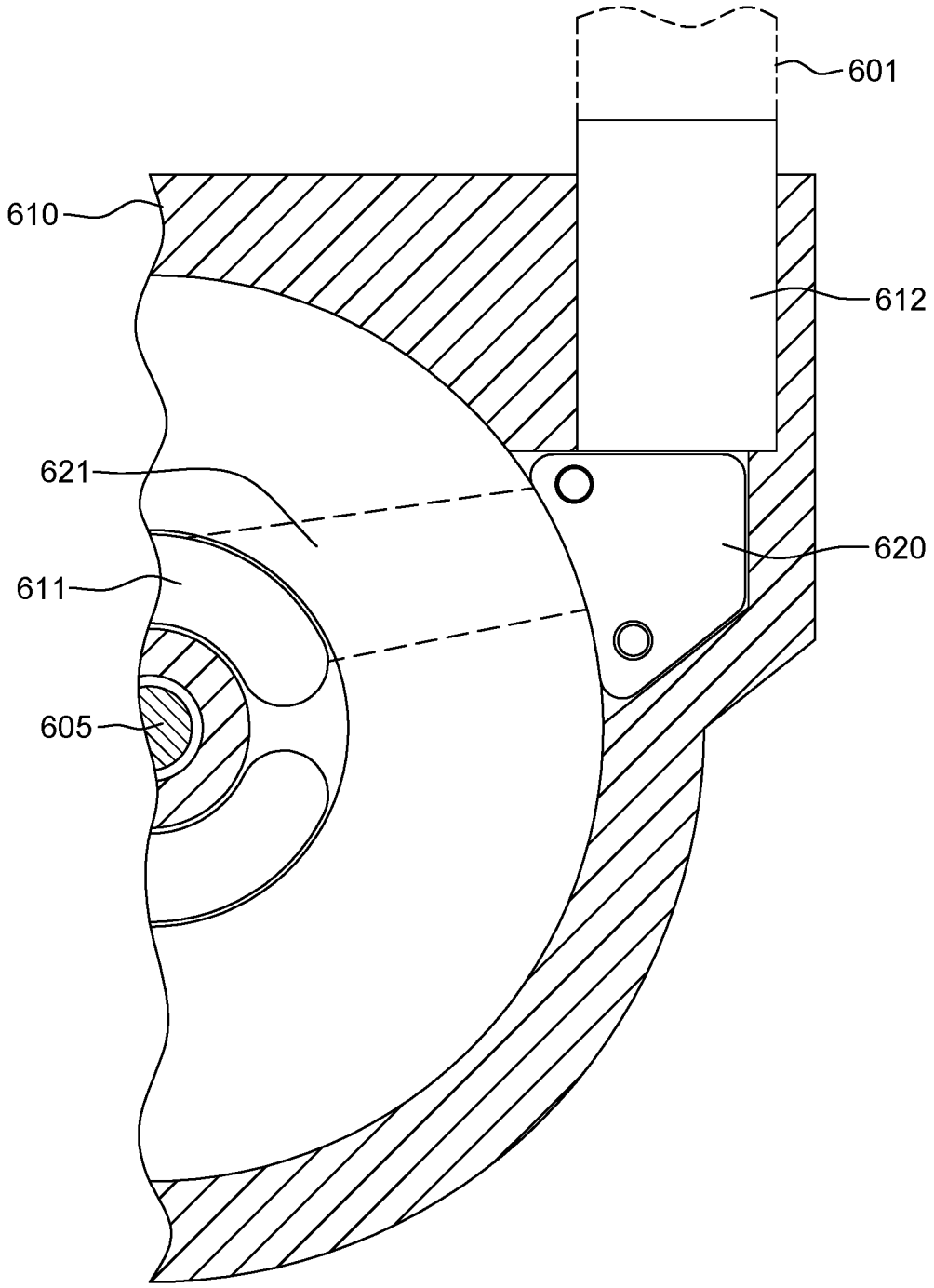
FIG. 6B is a partial cross-sectional elevational view of the pump of FIG. 6A, taken along line 6B-6B thereof, in accordance with one or more aspects of the present invention.

FIGS. 6A & 6B depict partial cross sectional elevational views of an alternate embodiment of a pump 600, in accordance with one or more aspects of the present invention. Referring to FIG. 6A, an impeller 606 again is driven by a motor (not shown) to rotate about a shaft 605, with a volute housing 610 being depicted having a fluid inlet 611, and a fluid outlet 612. Pump 600 may be coupled, in one or more implementations, to a coolant loop 601 of a cooling assembly, such as described herein. In this implementation, a bypass path 621 is provided within volute housing 610 between fluid inlet 611 and fluid outlet 612 with a valve 620, such as a reed valve, being disposed within volute housing 610 to direct fluid dependent on whether the pump is in operational state or nonoperational state. In one or more implementations, valve 620 is exposed on opposite sides to the bypass path 621 and to the high pressure side of the volute housing adjacent to the outlet. In operational state, low pressure at the fluid inlet of the spinning impeller 606 and high pressure at the fluid outlet forces the reed valve 620 against the volute housing, ensuring that the reed valve seals the bypass path from the fluid outlet. If the pump is disabled, or otherwise in nonoperational state, flow pressure from the serial (i.e., other) redundant pump(s) forces the reed valve open, providing the bypass path 621 directly from the fluid inlet to the fluid outlet of the volute housing 610. Note that this implementation of the bypass mechanism may also be used with a variety of pump types including, for instance, centrifugal pumps, diaphragm pumps, vane pumps, gear pumps, etc.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

What is claimed is:

1. An apparatus comprising:

a multiple pump system to provide a fluid flow;

the multiple pump system including a pump, the fluid flow passing through the pump in an operational state of the pump and passing through the pump in a non-operational state of the pump, the pump comprising:

a rotatable element;

a volute housing having a fluid inlet, a fluid outlet, and an operational path through the volute housing allowing the fluid flow to pass in the operational state of the pump from the fluid inlet through the rotatable element to the fluid outlet, wherein in the operational state of the pump, the rotatable element rotates, drawing the fluid flow through the fluid inlet of the volute housing, into the rotatable element and expelling the fluid flow at a higher pressure through the fluid outlet of the volute housing;

a bypass mechanism integrated, at least in part, with the volute housing and exposing in the nonoperational state of the pump, where the rotatable element is not driven by the pump to rotate, a bypass path through the volute housing allowing the fluid flow to pass from the fluid inlet to the fluid outlet thereof without passing through the rotatable element;

wherein the bypass mechanism comprises a spring disposed between the volute housing and the rotatable element so that, in the non-operational state, the spring forces the rotatable element against the volute housing, and wherein the bypass mechanism further comprises a groove in the volute housing located and configured so that, in the operational state, the higher pressure fluid exiting the rotatable element flows, in part, between the rotatable element and the volute housing and pressurizes the rotatable element from the volute housing, opposite the fluid inlet of the volute housing to actuate the rotatable element to move towards the fluid inlet of the volute housing, compressing the spring between the volute housing and the rotatable element; and wherein in the non-operational state, the spring moves the rotatable element away from the fluid inlet of the volute housing, exposing the bypass path for the fluid to flow through the volute housing without passing through the rotatable element.

2. The apparatus of claim 1, wherein in the nonoperational state, the bypass pass is defined between an end surface of the rotatable element and a surface of the volute housing.

3. The apparatus of claim 1, wherein the fluid outlet of the volute housing comprises an outlet flow diameter, and the bypass path comprises a bypass flow diameter sized relative to the outlet flow diameter to minimize pressure drop through the pump when in the nonoperational state.

4. The apparatus of claim 1, wherein the pump is one pump, and the apparatus further comprises at least one other pump connected in series fluid communication with the one pump, the at least one other pump facilitating flow of the fluid through the bypass path when the one pump is in the nonoperational state.

5. The apparatus of claim 1, wherein the pump is a centrifugal pump, and the apparatus further comprises a coolant loop, the pump being operatively coupled in fluid communication with the coolant loop to facilitate pumping of liquid coolant through the coolant loop, the fluid being the liquid coolant.

6. An apparatus comprising:

a coolant-cooled cooling assembly for facilitating cooling at least one electronic component;

at least one coolant pump in fluid communication with the coolant-cooled cooling assembly to facilitate flow of coolant through the coolant-cooled cooling assembly, the at least one coolant pump comprising:

a rotatable element;

a volute housing having a fluid inlet, a fluid outlet, and an operational path through the volute housing allowing the fluid flow to pass in an operational state of the pump from the fluid inlet through the rotatable element to the fluid outlet, wherein in the operational state of the coolant pump, the rotatable element rotates drawing the coolant through the fluid inlet of the volute housing, into the rotatable element and expelling the coolant at a higher pressure through the fluid outlet of the volute housing;

a bypass mechanism integrated, at least in part, with the volute housing and exposing in a nonoperational state of the coolant pump, where the rotatable element is not driven by the pump to rotate, a bypass path through the volute housing allowing the coolant to pass from the fluid inlet to the fluid outlet thereof without passing through the rotatable element;

wherein the bypass mechanism comprises a spring disposed between the volute housing and the rotatable element so that, in the non-operational state, the spring forces the rotatable element against the volute housing, and wherein the bypass mechanism further comprises a groove in the volute housing located and configured so that, in the operational state, the higher pressure coolant exiting the rotatable element flows, in part, between the rotatable element and the volute housing and pressurizes the rotatable element from the volute housing, opposite the fluid inlet of the volute housing to actuate the rotatable element to move towards the fluid inlet of the volute housing, compressing the spring between the volute housing and the rotatable element; and wherein in the nonoperational state, the spring moves the rotatable element away from the fluid inlet of the volute housing, exposing the bypass path for the coolant to flow through the volute housing without passing through the rotatable element.

7. The apparatus of claim 6, further comprising multiple coolant pumps coupled in series fluid communication with the coolant-cooled cooling assembly to facilitate flow of the coolant through the coolant-cooled cooling assembly, the multiple coolant pumps comprising the at least one coolant pump, and wherein at least one other coolant pump of the multiple series connected coolant pumps facilitates flow of the coolant through the bypass path when the at least one coolant pump is in the nonoperational state.

8. The apparatus of claim 7, wherein the fluid outlet of the volute housing comprises an outlet flow diameter, and the bypass path comprises a bypass flow diameter sized relative to the outlet flow diameter to minimize pressure drop through the at least one coolant pump when in the nonoperational state.

9. The apparatus of claim 6, wherein in the nonoperational state, the bypass pass is defined between an end surface of the rotating element and a surface of the volute housing.

10. A method comprising:

providing a coolant pump for a coolant-cooled cooling assembly to facilitate cooling at least one electronic component of an electronics system, the providing comprising:

providing a rotatable element;

providing a volute housing having a fluid inlet, a fluid outlet, and an operational path through the volute housing allowing the fluid flow to pass in an operational state of the pump from the fluid inlet through the rotatable element to the fluid outlet, wherein in the operational state of the coolant pump, the rotatable element rotates drawing coolant through the fluid inlet of the volute housing, into the rotatable element and expelling the coolant at a higher pressure through the fluid outlet of the volute housing;

providing a bypass mechanism integrated, at least in part, with the volute housing and exposing in a nonoperational state of the coolant pump, where the rotatable element is not driven by the pump to rotate, a bypass path through the volute housing allowing the coolant to pass from the fluid inlet to the fluid outlet thereof without passing through the rotatable element; and wherein providing the bypass mechanism comprises providing a spring disposed between the volute housing and the rotatable element so that, in the non-operational state, the spring forces the rotatable element against the volute housing, and wherein the bypass mechanism further comprises a groove in the volute housing located and configured so that, in the operational state, the higher pressure coolant exiting the rotatable element flows, in part, between the rotatable element and the volute housing and pressurizes the rotatable element from the volute housing, opposite the fluid inlet of the volute housing to actuate the rotatable element to move towards the fluid inlet of the volute housing, compressing the spring between the volute housing and the rotatable element, and in the nonoperational state, the spring moves the rotatable element away from the fluid inlet of the volute housing, exposing the bypass path for the coolant to flow through the volute housing without passing through the rotatable element.

* * * * *